United States Patent [19]

Green

[11] 4,138,981

[45] Feb. 13, 1979

[54] FUEL INJECTION PUMPING APPARATUS FOR INTERNAL COMBUSTION ENGINES

[75] Inventor: Alan C. Green, Woodley Green, England

[73] Assignee: Lucas Industries Ltd., Birmingham, England

[21] Appl. No.: 808,670

[22] Filed: Jun. 21, 1977

[30] Foreign Application Priority Data

Jun. 22, 1976 [GB] United Kingdom ..... 25821/76

[51] Int. Cl.[2] ..... F02M 39/02; F04B 3/00

[52] U.S. Cl. ..... 123/139 AQ; 123/139 AP; 123/139 AF; 417/462; 417/251

[58] Field of Search ..... 123/139 AP, 139 AQ, 123/139 AD, 139 AF, 140 FG; 417/462, 251

[56] References Cited

U.S. PATENT DOCUMENTS

| | | | |
|---|---|---|---|
| 3,936,232 | 2/1976 | Mowbray | 123/139 AQ |
| 4,014,305 | 3/1977 | Skinner et al. | 123/139 AQ |
| 4,019,835 | 4/1977 | Skinner | 123/139 AQ |
| 4,050,433 | 9/1977 | Tokashiki | 123/139 AQ |
| 4,074,667 | 2/1978 | Skinner | 123/139 AQ |
| 4,080,109 | 3/1978 | Green | 123/139 AQ |

FOREIGN PATENT DOCUMENTS

| | | | |
|---|---|---|---|
| 619139 | 4/1961 | Canada | 123/139 AQ |
| 2355347 | 5/1974 | Fed. Rep. of Germany | 123/139 AQ |
| 2629847 | 1/1977 | Fed. Rep. of Germany | 123/139 AQ |
| 925979 | 8/1961 | United Kingdom | 123/139 AQ |

*Primary Examiner*—Charles J. Myhre
*Assistant Examiner*—P. S. Lall

[57] ABSTRACT

A fuel pumping apparatus comprises a piston movable by fluid pressure to vary the timing of delivery of fuel to an associated engine. Valve means provides fuel under pressure which varies in accordance with the speed at which the engine is driven and fuel at this pressure is applied to the piston through a first fixed orifice. A second fixed orifice is connected to the downstream side of the first orifice and a variable orifice is provided to control the fluid flow through the second orifice. The size of the variable orifice is dependent upon the amount of fuel supplied to the associated engine by the apparatus. In addition a pressure responsive valve is provided which defines a flow path connected in parallel with one of the orifices, the valve being subjected to a fluid pressure within the system.

9 Claims, 4 Drawing Figures

FUEL INJECTION PUMPING APPARATUS FOR INTERNAL COMBUSTION ENGINES

This invention relates to fuel injection pumping apparatus for supplying fuel to internal combustion engines and of the kind comprising an injection pump for delivering fuel in timed relationship to an associated engine, a feed pump for supplying fuel to the injection pump during the filling periods thereof, throttle means for adjusting the amount of fuel supplied by the feed pump to the injection pump and fluid pressure operable means for adjusting a component of the injection pump to vary the timing of delivery of fuel to the associated engine.

The object of the present invention is to provide an apparatus of the kind specified in a simple and convenient form and in which adjustment of the timing of injection can be obtained for varying settings of the throttle means.

According to the invention an apparatus of the kind specified comprises a valve means operable to provide a fluid pressure which increases as the speed of operation of the apparatus increases, a first fixed orifice through which said fluid pressure is applied to said fluid pressure operable means, a second fixed orifice and through which fluid from the downstream side of said first fixed orifice can flow to a drain, a variable orifice connected in series with said second orifice and operable to vary the fluid pressure applied to said fluid pressure operable means, the size of said variable orifice being determined by the setting of said throttle means, and a pressure responsive valve operable to provide a flow path in parallel with one of said orifices, said valve being responsive to a fluid pressure within the system.

Two examples of apparatus in accordance with the invention will now be described with reference to the accompanying drawings in which.

Figure 1:
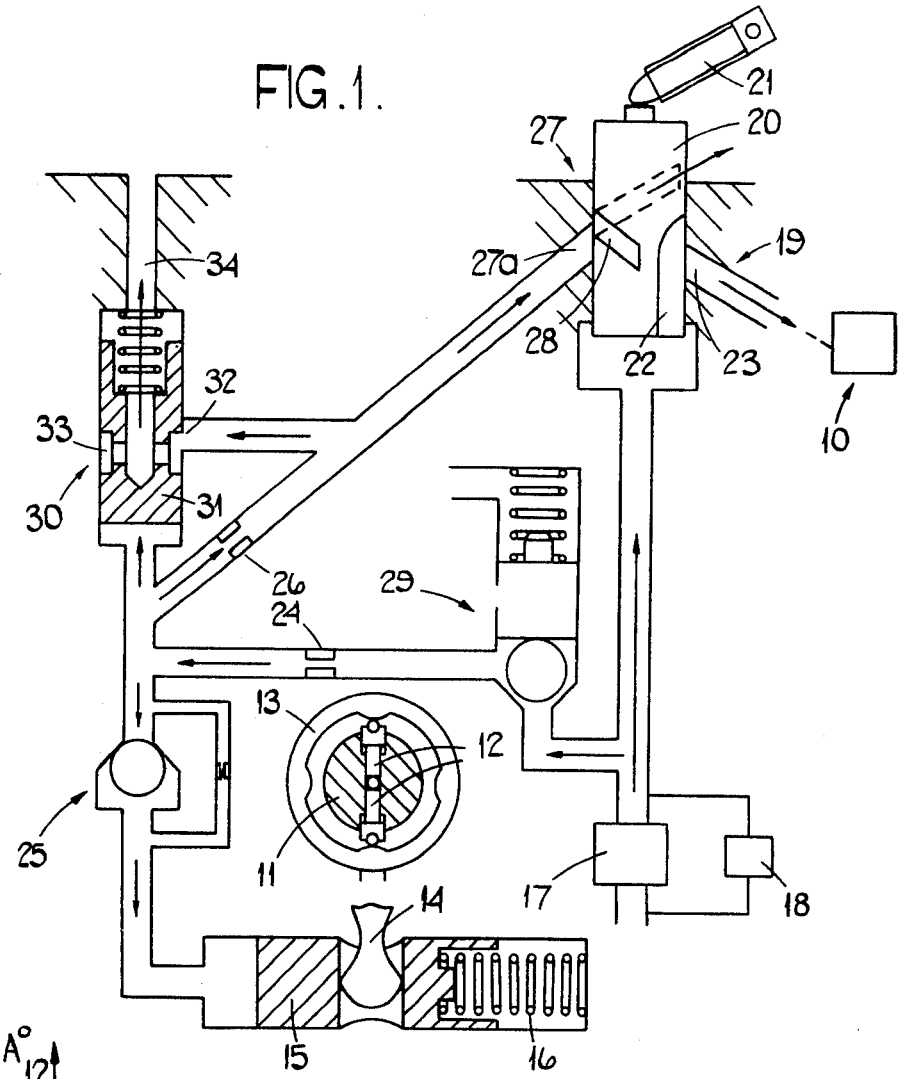
FIG. 1 is a diagrammatic representation of the first example of the apparatus.

With reference to FIG. 1 of the drawings the pumping apparatus comprises an injection pump generally indicated at 10 but including a rotary distributor member 11 which is housed within a body part (not shown) of the apparatus, the distributor member being adapted to be driven in timed relationship with the associated engine. Formed in the distributor member is a transversely extending bore which accommodates a pair of pumping plungers 12 which are moved inwardly as the distributor member rotates, by the co-operation of rollers at the outer ends of the plungers engaging with the internal periphery of an annular cam ring 13 having formed on its internal periphery, pairs of inwardly extending cam lobes.

The fuel displaced by the injection pump during the injection strokes thereof is distributed in known manner in turn to injection nozzles associated with the combustion chambers of the associated engine.

The cam ring 13 is angularly adjustable in order to determine the timing of delivery of fuel to the associated engine and for this purpose the cam ring is provided with a peg 14 which is engaged within a recess defined in a fluid pressure operable piston 15 which constitutes the aforesaid fluid pressure operable means. The piston is spring loaded by means of a spring 16 towards one end of the cylinder in which it is mounted. As the piston 15 moves under the action of the spring 16 the timing of injection of fuel is retarded.

The apparatus also includes a feed pump 17 conveniently having a rotary part which is mounted on the distributor member 11. The feed pump draws fuel from a convenient source not shown and the output pressure of the feed pump is controlled by valve means 18 so that as the speed of operation of the associated engine increases, the outlet pressure of the feed pump also increases.

The amount of fuel which is supplied by the injection pump at each delivery stroke is determined by the amount of fuel which is supplied to it during the filling strokes, by the feed pump and the fuel flowing to the injection pump is controlled by a throttle means 19. In the particular example the throttle means comprises an angularly adjustable throttle member 20 mounted within the body part of the apparatus and its angular setting is determined in part by a mechanical governor which is responsive to the speed at which the apparatus is driven, and in part to the setting of an operator adjustable member. Conveniently the throttle member is housed within a bore formed in the body part and extends from the bore into contact with a stop member 21.

The other end of the throttle member is subjected to the outlet pressure of the feed pump and formed in the throttle member is an axial groove 22 which registers to a varying degree, with a port 23 formed in the wall of the cylinder in which the throttle member is mounted. The port 23 by way of further ports and passages in the body and distributor member, is brought into communication with the injection pump during the filling periods thereof. The angular setting of the throttle member therefore determines the amount of fuel which is supplied by the feed pump to the injection pump during the filling strokes thereof.

In order to adjust the timing of delivery of fuel the piston 15 is subjected to varying fluid pressure. The fluid pressure is derived from the outlet of the feed pump but is modified in accordance with the setting of the throttle member 20. The outlet of the feed pump communicates with the cylinder containing the piston 15 by way of a first fixed orifice 24 and the downstream side of this orifice is connected to the cylinder containing the piston by way of a valve 25 the purpose of which is to minimise so far as possible movement of the piston by the reaction of the rollers with the cam lobes. A small bleed orifice is provided in parallel with the valve 25 to permit fuel to escape from the cylinder as the piston is moved by the spring 16.

The downstream side of the orifice 24 also communicates with a drain by way of a second fixed orifice 26 connected in series with a variable orifice 27 which is constituted by a port **27*a* in the wall of the cylinder in which the throttle member is mounted and by an inclined groove 28 formed in the periphery of the throttle member. It is arranged that as the throttle member 20 is moved angularly to increase the amount of fuel supplied to the engine, the degree of restriction offered by the variable orifice 27 decreases so that an increased flow of fuel takes place through the fixed orifices 24, and 26 with the result that the pressure applied to the piston 15** is reduced.

Figure 2:
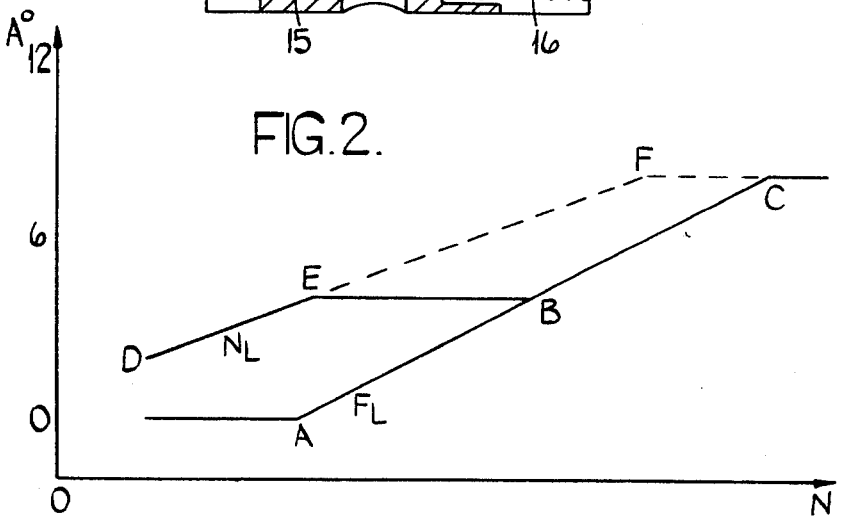
FIG. 2 is a graph showing the performance characteristics of the apparatus of FIG. 1 with engine speed N plotted against degrees of Advance A°.

Also shown in FIG. 1 is a pressurising valve 29 the action of which is to prevent flow of fuel through the orifice 24 until the outlet pressure of the feed pump has attained a predetermined value. FIG. 2 shows the characteristic obtained with the apparatus so far described. With the throttle member 19 set to provide the maximum flow of fuel to the injection pump the orifice 27 offers least restriction and there will be an appreciable pressure drop across the orifice 24. However, the pressure applied to the piston 15 will increase with speed and the piston 15 will therefore move as the speed increases. The degree of advance is indicatated by the line A, B, C, in FIG. 3. If the throttle member is set to provide minimum fuel i.e. the engine is operating under light load conditions, then the orifice 27 offers most restriction and therefore the pressure applied to the piston will be higher and again will increase with speed. The degree of advance obtained is indicated by the line D, E, F.

In some engine applications it is desirable that under light load condition the advance characteristic should follow the line D, E, B, C. This is obtained by providing the auxilliary valve 30 shown in FIG. 1. The valve 30 includes a spring loaded piston 31 which is moved against the action of its spring by the pressure downstream of the orifice 24. Moreover, formed in the wall of the cylinder containing the piston is a port 32 connected to a point downstream of the orifice 26, and the port can register with a groove 33 in the piston and which communicates with a drain 34, the port and groove defining a flow path the degree of restriction offered by which decreases as the pressure downstream of the orifice 24 increases.

In operation as the pressure downstream of the orifice 24 increases a pressure will be attained corresponding to point E at which the flow path is opened. As the speed increases the piston 31 moves to maintain the pressure downstream of the orifice substantially constant giving rise to the portion E, B of the characteristic. When the degree of restriction offered by the flow path can no longer reduce the pressure downstream of the orifice 24, starts to increase giving rise to the portion B, C, of the characteristic. It will be noted that the flow path defined by the auxilliary valve is effectively in parallel with the variable orifice 27.

Figure 3:
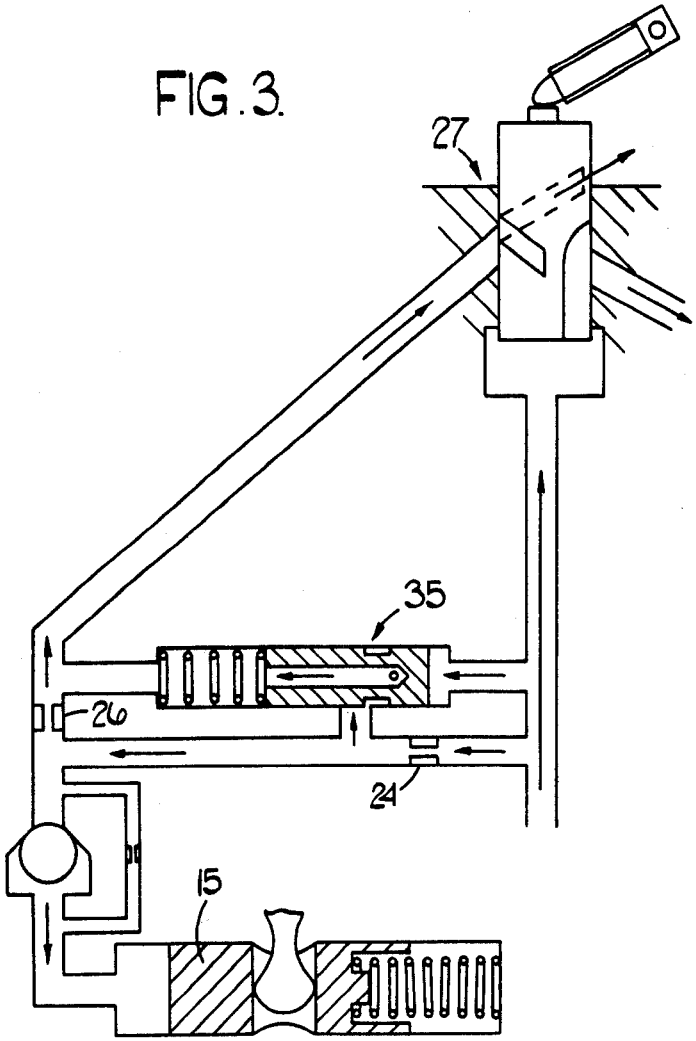
FIG. 3 is a view similar to FIG. 1 of another example of the apparatus.
Figure 4:
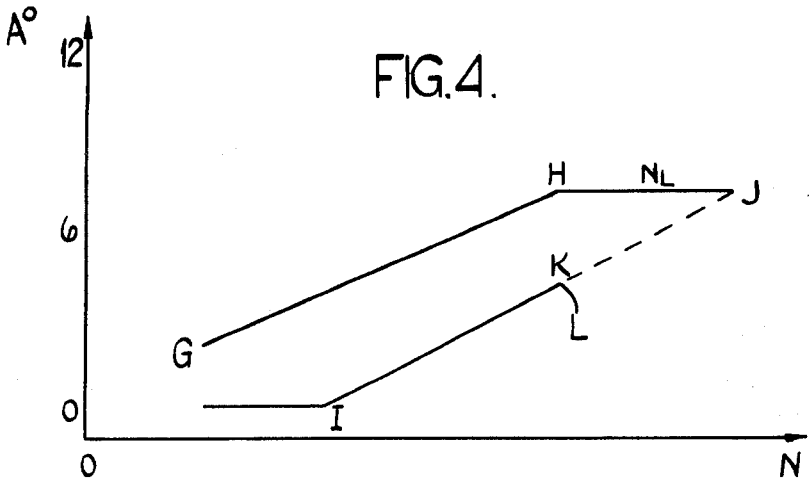
FIG. 4 is a graph showing the performance characteristics of the apparatus of FIG. 3.

Turning now to FIG. 3. It will be noted that the pressurising valve 29 has been omitted but an equivalent valve can be inserted upstream of the variable orifice 27. The auxilliary valve 35 in this case has a flow path connected in parallel with the orifice 26. The construction of the valve is similar to the valve 30 but in this case the piston is subjected to the outlet pressure of the pump 17. Referring to FIG. 4 without the auxilliary valve the portion G, H corresponds to the portions D, E, F, of FIG. 2, and the portion I. J. corresponds to the portions A, B, C, of FIG. 2. The piston of the auxilliary valve is subjected to the outlet pressure of the feed pump and has its greatest effect when the variable orifice 27 is fully open i.e. when the throttle member is set to provide maximum fuel. As the engine speed increases the output pressure of the feed pump increases and at a predetermined pressure corresponding to point K, the piston of the auxilliary valve will start to move. Additional flow of fuel will therefore take place through the orifice 24 and the pressure downstream of this orifice will decrease so that a reduced pressure is applied to the piston 15. The portion K, L of the curve of Figure shows the effect obtained and it will be noted that even though the engine speed continues to increase the pressure applied to the piston 15 continues to fall at least until the maxium governed speed of the engine is attained.

In some cases it is desirable that the operation of the auxilliary valve should vary in accordance with the temperatures. One way of achieving this is to make use of the variation in the viscosity of the fuel which occurs with temperature variation. The fixed orifices which as so far described are sharp edged orifices, may comprise passages of small section so that they are viscosity sensitive.

In the example of FIG. 1 if the orifice 24 or 26 is made viscosity sensitive then the position of the portion E, B of the curve of FIG. 2 will depend on the temperature of the fuel, the points E and B occuring at a higher engine speed, the lower the fuel temperature.

I claim:

1. A fuel injection pumping apparatus for supplying fuel to internal combustion engines comprising an injection pump for delivering fuel in timed relationship to an associated engine, a feed pump for supplying fuel to the injection pump during the filling periods thereof, throttle means for adjusting the amount of fuel supplied by the feed pump to the injection pump and fluid pressure operable means for adjusting a component of the injection pump to vary the timing of delivery of fuel to the associated engine, valve means operable to provide a fluid pressure which increases as the speed of operation of the apparatus increases, a first fixed orifice through which said fluid pressure is applied to said fluid pressure operable means, a second fixed orifice and through which fluid from the down stream side of said first fixed orifice can flow to a drain, a variable orifice connected in series with said second orifice and operable to vary the speed responsive pressure applied to the fluid pressure operable means, the size of said variable orifice being determined by the setting of said throttle means, and a pressure responsive valve operable to provide a flow path in parallel with one of said orifices, said valve being responsive to a fluid pressure within the system.

2. An apparatus according to claim 1 in which said pressure responsive valve comprises a resiliently, load valve element, the flow path being defined by a port in the wall of a cylinder in which the valve element is slidable, and a groove formed in the body of the valve for register with said port.

3. An apparatus according to claim 2 in which the flow path defined by said pressure responsive valve is connected in parallel with said variable orifice, the valve element being subjected to the pressure downstream of said first fixed orifice.

4. An apparatus according to claim 3 in which the fuel which flows through said variable orifice flows to a drain.

5. An apparatus according to claim 2 in which the flow path defined by said pressure responsive valve is connected in parallel with said second fixed orifice, the valve element of the pressure responsive valve being subjected to the fluid pressure determined by said valve means.

6. An apparatus according to claim 5 in which the fuel which flows through said variable orifice flows to a drain.

7. An apparatus according to claim 1 in which said valve means controls the outlet pressure of the feed pump and the apparatus includes a pressurizing valve operable to prevent flow of fluid through the orifices until the output pressure of the feed pump has attained a predetermined value.

8. An apparatus according to claim 1 in which said fixed orifices are sharp edged orifices.

9. An apparatus according to claim 1 in which at least one of said fixed orifices is sensitive to the viscosity of the fluid.

* * * * *